United States Patent [19]

Lawson

[11] 4,123,856

[45] Nov. 7, 1978

[54] KICKING SHOE

[76] Inventor: Bobbie G. Lawson, 4845 Belinder Ct., Shawnee Mission, Kans. 66205

[21] Appl. No.: 822,047

[22] Filed: Aug. 5, 1977

[51] Int. Cl.[2] ..... A43B 5/00; A43B 7/14

[52] U.S. Cl. ..... 36/133; 36/93; 36/114

[58] Field of Search ..... 36/133, 83, 50, 71, 36/54, 113, 114, 93

[56] References Cited

U.S. PATENT DOCUMENTS

| | | | |
|---|---|---|---|
| 2,095,869 | 10/1937 | Hermson | 36/114 |
| 2,107,667 | 2/1938 | Hermson | 36/83 |
| 3,169,326 | 2/1965 | Butera | 36/93 |
| 3,350,796 | 11/1967 | Bealle | 36/133 |
| 3,406,469 | 10/1968 | Dani | 36/133 |
| 3,668,182 | 10/1973 | Powers | 36/114 |
| 3,934,346 | 1/1976 | Sasaki | 36/50 |

*Primary Examiner*—Patrick D. Lawson

*Attorney, Agent, or Firm*—Fishburn, Gold & Litman

[57] ABSTRACT

A kicking shoe is disclosed which comprises wedging means in the toe box for maintaining the toes of a wearer in an upwardly flexed position. The resulting forward flexure of the toes facilitates "locking" of the wearer's ankle, and causes kicking force to be transmitted to a ball through the heads of the metatarsal bones of the foot rather than through the toes. Accordingly, the accuracy and distance of kicking are significantly improved by use of the shoe.

24 Claims, 8 Drawing Figures

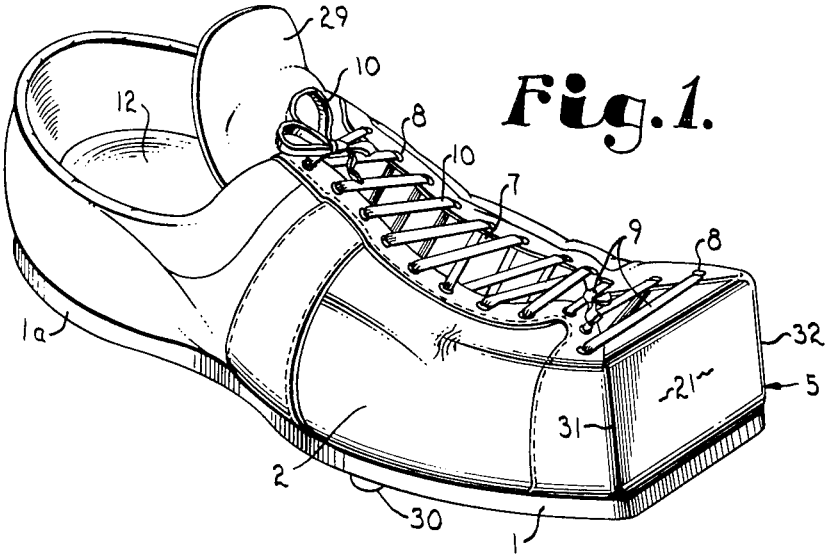
Fig. 1.
Fig. 2.
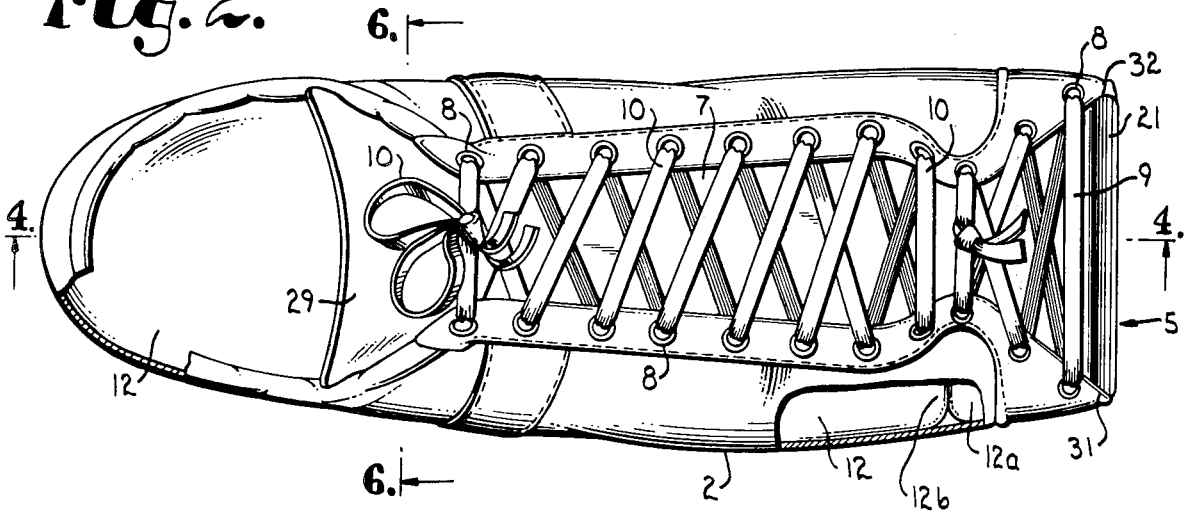
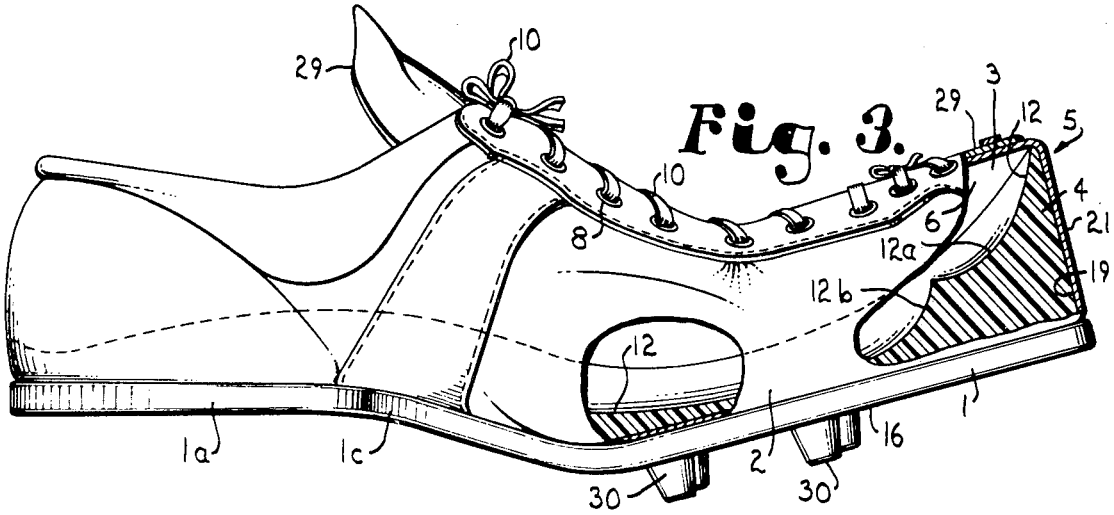
Fig. 3.

KICKING SHOE

BACKGROUND OF THE INVENTION

The present invention pertains to athletic footwear, and more particularly pertains to a shoe or boot for kicking a football, soccer ball, or the like, when the intention is to strike the ball solidly with the front end of the foot, as when place kicking a football.

Whether designed for the dual purpose of playing and kicking, or for the singular purpose of kicking, prior football shoes do not possess requisite features of construction that establish and maintain the bones of a kicker's foot in optimal alignment for maximizing kicking distance and accuracy. Design of the present kicking shoe arose from my discovery that placing and holding the kicker's toes in an upwardly flexed position greatly aids in establishing and maintaining the ankle in a "locked" position, while also permitting kicking force to be transmitted to the ball directly from the heads of the metatarsal bones of the foot rather than through the toes. It will be appreciated that the metatarsals are relatively immobile compared to the toes, since the latter are multijointed and can be easily bent of flexed up and down. Accordingly, the front of the kicker's foot should be lifted upward until it extends substantially at a right angle to the lower leg, thereby "locking" the ankle for maintaining the foot at such an angle with the leg when the ball is kicked, and the toes should be flexed sharply upward to (1) prevent unwanted absorption of kicking force by inadvertent bending or flexing of the toes, (2) help place and maintain the ankle in the desired "locked" position, and (3) expose the heads of the metatarsal bones of the foot so that kicking force can be delivered through the heads of the metatarsals.

SUMMARY OF THE INVENTION

It is therefore an object of the present invention to provide a shoe or boot having improved features that aid a ball player when kicking a ball.

Another object is to provide a shoe or boot for aiding the kicking of a ball by placing and maintaining the bones of a kicker's foot in optimum alignment for delivery of maximum impact to the ball and for controlling the ball's direction of flight.

Still another object is to provide a kicking shoe that is longitudinally rigid in the sole area to prevent the bending thereof when a ball is kicked.

Yet another object is to provide a kicking shoe having a front section that is maintained in an upwardly inclined relation to the rear part of the shoe, and which also includes means for flexing the wearer's toes upwardly within the inclined front section.

Even another object is to provide a kicking shoe having a rigid portion for urging the wearer's toes and metatarsal bones into a desired alignment.

Other objects and advantages of the present invention will become apparent from the following description, the drawings and the appended claims.

The present invention is a kicking shoe that comprises a sole, a vamp, a toe box, and wedging means within the toe box for maintaining the toes of a wearer of the shoe in an upwardly flexed position.

In advantageous embodiments of the invention, the wedging means is provided with an upper surface which abuts the bottom of a wearer's toes and is upwardly inclined toward the front of the shoe. To furnish additional support that urges the bones of a wearer's foot into a preferred alignment, the wedging means can extend rearwardly of the toe box for support of the plantar and/or metatarsal arches of the foot. Where preferred, the wedging means can be rigid or semi-rigid, can be integral with the sole of the shoe for unitized construction and/or rigidizing of the sole, and can extend to the forward limit of the toe box to prevent the collapse thereof, and whereby relatively uncushioned delivery of kicking force to the ball from the heads of the metatarsals is assured.

BRIEF DESCRIPTION OF THE DRAWINGS

FIG. 1 is a perspective view of a kicking shoe constructed in accordance with the present invention.

FIG. 2 is a top view of the kicking shoe shown in FIG. 1.

FIG. 3 is a partially sectional side view of the kicking shoe shown in FIGS. 1 and 2.

DESCRIPTION OF PREFERRED AND ALTERNATIVE EMBODIMENTS

Figure 4:
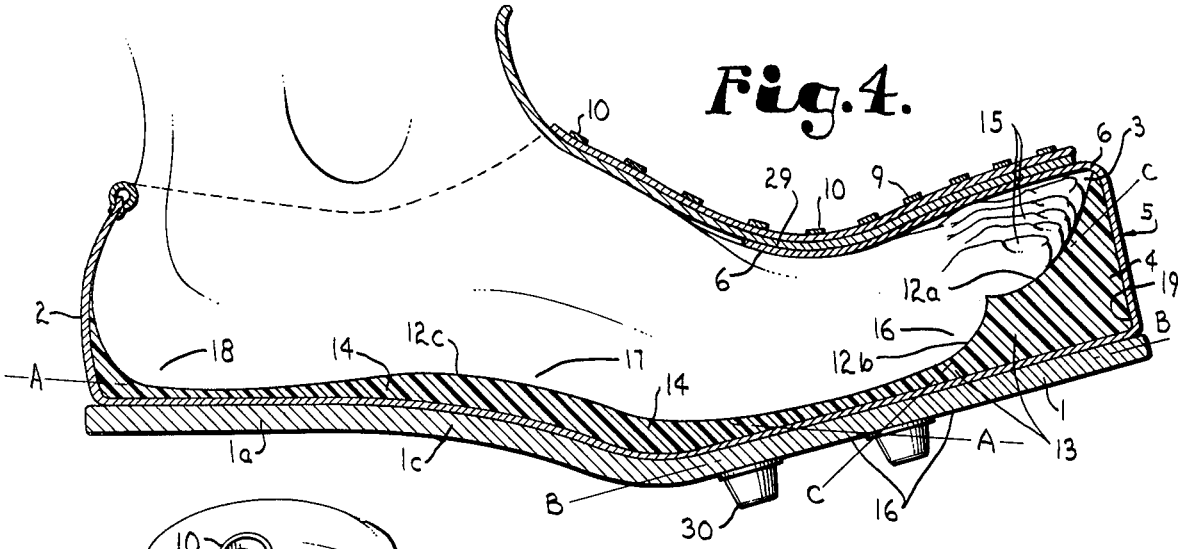
FIG. 4 is a sectional side view of the kicking shoe of FIG 1, along line 4—4 therein, and further illustrates emplacement of the shoe on a wearer's foot.
Figure 5:
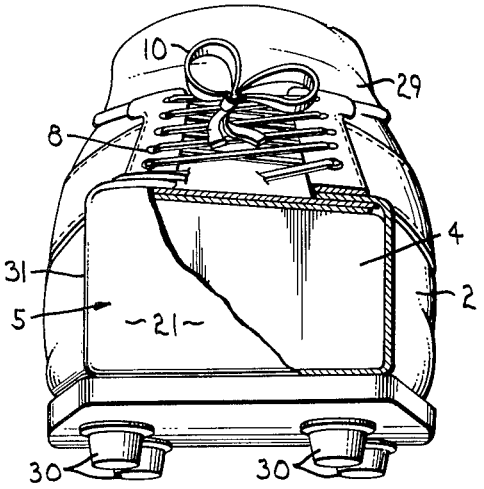
FIG. 5 is a partially sectional front view of the kicking shoe of FIG. 1.
Figure 6:
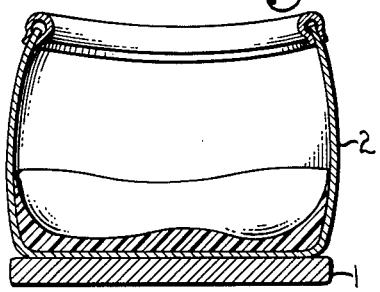
FIG. 6 is a sectional view of the kicking shoe taken along line 6—6 of FIG. 2.

In FIGS. 1-3, the kicking shoe shown therein comprises a sole 1, a vamp 2, and a toe box 3. A wedging means for flexing the wearer's toes upwardly is generally represented at 4. The vamp and the sole are attached to each other by conventional means, e.g. by stitching, and there is a substantially flat, trapazoidal cap 5 that is located at the forward limit of the toe box and which abuts the front end of the wedging means 4. The top of cap 5 merges with a rearwardly extending inner flap or tongue 6 that covers the front portion of the wearer's foot and tightly holds the cap in place against the wedging means when the shoe is firmly laced to snug the vamp against the sides of the foot.

To facilitate placement of the shoe on the foot, the vamp has a longitudinally extending central opening 7 therein which extends rearwardly from the toe box. Eyelets 8 extend through the vamp on each side of the central opening and are located at spaced intervals from the front of the toe box rearwardly. It should be noted that a first lace 9 is strung in the eyelets adjacent the toe box that extends to the forward end of the inner cavity of the shoe, and that a second lace 10 is strung in the eyelets located rearwardly of the toe box. Accordingly, the first lace 9 can be securely tightened to snug the vamp and the inner tongue 6 against the toes so that they are pressed firmly down against the wedging means 4. The second lace 10 can be separately tightened to secure the shoe against the instep of the wearer and thereby pull the lower inner surface 11 of the shoe tightly against the sole of the foot.

Referring to FIG. 3, the wedging means 4 has an upper surface thereon, which is generally represented at 12, for abuttal with the bottom of the wearer's toes, and this upper surface is inclined upwardly toward the top front of the shoe. To advantage, the inclined upper surface has both front and rear sections, the front section 12*a* being for contact with the bottom of the toes so they can be forced into upward flexure by the wedging means, and the rear section 12*b* being for abuttal with the bottom and front of the metatarsal arch for support thereof by the wedging means 4. As can be seen in FIG. 4, the wedging means can include merging front and rear portions, represented at 13 and 14 respectively, over which inclined upper surface 12 extends. Accordingly, the first section 12*a* and second section 12*b* of the upper surface are located on the front portion of the wedging means that supports the toes 15 and the metatarsal arch 16, respectively, of the wearer's foot, whereas the plantar arch 17 of the foot abuts a third section 12*c* of the rear portion of the wedging means.

Where preferred, the rear portion 14 of the wedging means can also extend beneath the heel 18 of the wearer as shown in the drawings, and both front and rear portions can be integral and molded to provide an inner surface that conforms to the entire bottom of a human foot, including the toes, heel and the arches. Furthermore, the wedging means can be separately molded or otherwise shaped from materials such as plastic, rubber, blends of rubber and plastic, leather, fiberglass reinforced resin, wood, or metal to form an insert having a desired configuration, and the insert can then be attached to the rest of the shoe by means of glue, stitching, nails, screws, or a combination thereof, to provide an integral shoe structure that comprises the insert. When the sole of the shoe is molded from rubber, plastic, or rubber-plastic compositions, the wedging means can be cast as a molded portion of the sole, thus obviating the need to form the wedging means separately. Ideally, of course, the wedging means is shaped to precisely fit the bottom of a particular person's foot, thereby providing maximum comfort and ideal alignment of the bones of the foot, but standardized shapes can be produced that will fit a variety of feet.

To prevent collapse of the toe box 3 of the shoe when kicking a ball and to thereby increase transmission of kicking force to the ball, at least the forward portion 13 of the wedging means should be a rigid wedge that extends to the forward limit of the toe box. It is preferred, therefore, that the wedge abut a substantial portion of the inside face 19 of the cap 5 of the toe box, thereby supporting the cap so that it does not collapse inwardly upon kicking contact with a ball, and also protecting the wearer's toes against impact. Additionally, both the front and rear portions 13 and 14 of the wedging means can be rigid for assured alignment of the toes and metatarsals, and to rigidize the sole of the shoe longitudinally so that it does not bend when a ball is kicked. It will be appreciated, however, that the sole can be rigidized in some other fashion, e.g. by means of a steel shank that is placed between the wedging means and the sole and attached to the latter.

To advantage, the sole of the present kicking shoe can have a rear portion 1*a* that extends beneath the heel 18 of the wearer, an intermediate portion 1*c* that extends beneath the plantar arch 17, and a forward portion 1*b* that extends beneath the metatarsal arch 16 and the toes 15, with the forward portion 1*b* of the sole being permanently maintained in an upwardly flexed orientation with respect to the plantar surface reference line A—A of the shoe. The term "plantar surface reference line" as used herein is an imaginary line that extends through the lowest points at which the heel and the metatarsal arch of the wearer's foot contacts the inside surface of the bottom of the shoe, as shown in FIG. 4. The term "upwardly flexed" as used herein with reference to the toes of the foot or the sole of the shoe is intended to mean that they are bent or turned upward when the sole of the foot or shoe is facing downward. The term "permanently maintained" as used herein with respect to flexed orientation of the shoe sole is intended to mean that the sole cannot flex in use to a different orientation with respect to the plantar surface reference line without damaging the construction of the shoe. The advantage in the permanently upwardly flexed orientation of the front portion of the sole is that it assists the kicker in not allowing the toe of the shoe to strike the ground when a ball is kicked, and it also helps raise the kicker's toes to a desired level above the plantar surface reference line for optimum alignment of the bones of the foot for the purpose of kicking.

Figure 7:
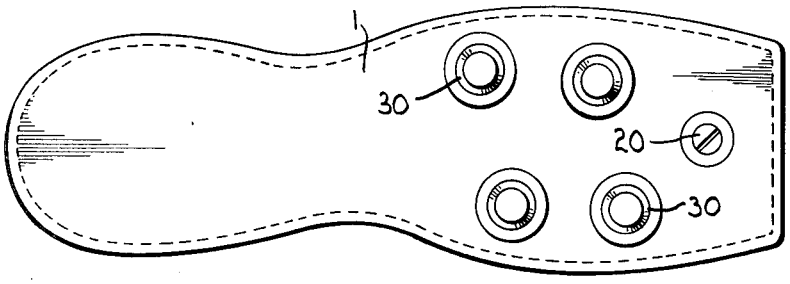
FIG. 7 is a bottom view of the kicking shoe of FIG. 1.

In conjunction with flexure of the front portion of the sole to an upwardly inclined orientation, the rear portion 1*a* of the sole can be permanently maintained in a substantially level orientation with respect to the plantar surface reference line, and the intermediate portion 1*c* can be permanently maintained in a downwardly flexed orientation with respect to the reference line. The front, rear and intermediate portions of the sole can be maintained in the orientations mentioned above by means of a rigid shank attached to the sole. When a rigid wedging means is used that extends beneath the toes, arches and heal of the wearer's foot, it can be attached to the sole so as to function as a shank, and in such a case it is not essential that the wedging means be attached to the sole along its entire length. As shown in FIG. 7, a single screw 20 can be used to pull the wedging means tightly against the sole of the shoe, and it will be appreciated that the wearer's foot also aids in pressing the wedging means against the sole. As previously indicated, the wedging means is advantageously rigid and incompressible during normal conditions of use, thereby aligning the bones of the foot as desired, preventing collapse of the toe box of the shoe and effecting or facilitating rigidization of the sole of the shoe.

To advantage, the forward portion 1*b* of the shoe sole can be permanently maintained in an upwardly flexed orientation of at least about 35°, i.e., when measured between a longitudinal plane B—B through which the sole extends and the plantar surface reference line A—A. In addition, the upper surface portions 12*a* and 12*b* on the wedge 4 can be advantageously inclined upwardly from the plantar surface reference line at an angle which exceeds that at which the forward portion of the sole is permanently maintained with respect to the reference line A—A. For example, the angle of upper surface portions 12*a* and 12*b* on the wedge, as represented by line C—C, can be about 30° as measured from the sole plane B—B, while the angle between the sole plane and the plantar surface reference line A—A is 15°. In such a case, the toes of the wearer's foot would therefore be lifted by the wedge 4, and also by the upward tilting of the front sole portion 1*b*, to an angle of about 45° as measured from the plantar surface reference line. In any case, the toes of the wearer should be flexed upward by the wedging means, or by the wedging means and upward flexing of the sole, to an angle of at least 35° as measured from the plantar surface reference line, and preferrably to an angle of about 45° or greater.

As was previously indicated, the front of the toe box 3 can be provided with a substantially flat cap 5. To advantage, the cap can be forwardly tilted with respect to the sole plane B—B, preferably at an angle within the range of about 100° to about 110° thereto when measured from inside the shoe. In addition, the cap can have a flat, trapizoidal outer face 21, and the outer side 31 of said cap can have a greater height than the inner side 32 thereof, it being understood that the inner side is the side on which the great toe of the wearer's foot resides.

As shown in the drawings, the sole of the shoe is devoid of cleats beneath the toe box 3. This further assists the wearer in not striking the ground with the toe of the shoe when kicking a ball. Since the shoe is intended for use when kicking, and not for continuous playing, the sole portion beneath the wearer's heel can also be devoid of cleats. When cleats 30 are attached to the sole, they can to advantage be located only on a portion thereof which resides beneath the metatarsal arch of the wearer's foot.

Figure 8:
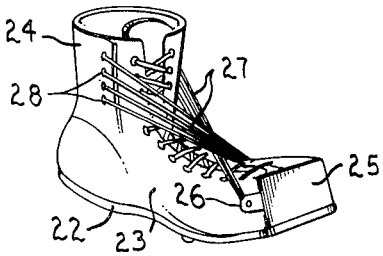
FIG. 8 is a perspective view of a kicking boot constructed in accordance with the present invention, and including lace and anchor means for maintaining the front portions of the boot in an upwardly inclined orientation.

The term "shoe" as used herein is intended to mean any piece of footwear that can be securely attached to a human foot, including shoes and boots. FIG. 8, for instance, represents a boot constructed in accordance with the present invention, and includes a sole 22, a vamp 23, an upper 24, and a cap 25 on the toe box. The boot also comprises anchoring means 26 for laces 27 on each side of the toe box, and attachment means for the laces 28, e.g. hooks on each side of the upper. The laces 27 are tugged toward the wearer's ankle, either to pull the front portion of the sole 22 to an upwardly flexed orientation as shown, or to help maintain such an orientation in the event the sole is rigid or semi-rigid and are fastened to the attachment means 28. Should the wearer prefer a low-cut shoe as shown in FIGS. 1–7, the laces 27 can be tied around the ankle. It will be appreciated that an upper in conjunction with the vamp of the shoe is helpful in establishing and maintaining the ankle in the preferred "locked" position.

As shown in the drawings, the shoe includes an outer tongue 29 that resides beneath the medial opening 7 in the vamp and covers it from below. This outer tongue 29 is not attached to the cap 5 along with the inner tongue 6, but is instead sewn to the vamp along one side of the medial opening 7, and is folded sideways over the instep of the foot when the shoe is being put on. Accordingly, the inner tongue 6 is first emplaced against the wearer's toes and the lower portion of the instep by folding it toward the ankle, followed by folding the outer tongue sideways across the inner tongue and the upper portion of the instep. Lace 9 is then tightened to provide a secure fit at the toes, followed by tightening of lace 10 to cinch the shoe to the remainder of the foot.

By reference to FIG. 4, it can be determined that the metatarsal heads of the wearer's foot, which reside inside the foot at the metatarsal arch 16, are exposed by elevation of the toes so as to transmit kicking force outwardly through the wedging means 4 and the cap of the toe box when a ball is kicked. The toes are maintained in this upwardly flexed position by the wedging means, and are thus prevented from flexing and bending, although kicking force is not transmitted through their length. Upward urging of the toes and the metatarsal arch also helps the kicker to position the ankle and maintain it in the "locked" position shown in FIG. 4.

A kicking shoe has been disclosed herein that fulfills the previously stated objects of the invention, and although the present shoe has been described with reference to specific embodiments thereof, it will be understood that still other embodiments will become apparent that are within the spirit and scope of the invention defined in the following claims.

What is claimed and desired to secure by letters Patent is:

1. A kicking shoe having a ball engaging surface and wedging means therewithin maintaining the toes of a wearer of the shoe in an upwardly flexed position, thereby directing the front of the metatarsal arch toward said ball engaging surface, said wedging means including merging front and second sections shaped for supporting abuttal respectively with the bottom of the wearer's toes and said front of the wearer's metatarsal arch, said wedging means being rigid and incompressible during normal use of the shoe.

2. A kicking shoe as in claim 1 wherein said wedging means has an upper surface for said abuttal with the bottom of a wearer's toes, and said upper surface is inclined upwardly toward the front of the shoe.

3. A kicking shoe as in claim 2 wherein said upper surface is inclined at an angle of at least about 35° with respect to the plantar surface reference line of said shoe.

4. A kicking shoe as in claim 1 wherein said shoe includes a toe box and said wedging means is an integral portion of the shoe.

5. A kicking shoe as in claim 1 wherein said wedging means is a rigid wedge that extends to the forward limit of said toe box.

6. A kicking shoe as in claim 5 wherein said shoe includes a sole and said toe box comprises a cap at the forward end thereof, said cap having an inside face and an outside face and extending vertically and transversally with respect to said sole, and said wedge abuts a substantial portion of said inside face of the cap.

7. A kicking shoe as in claim 6 wherein the outer face of said cap is substantially flat.

8. A kicking shoe as in claim 1 wherein said wedge is contoured to conform to the bottom of a human foot.

9. A kicking shoe as in claim 6 wherein said outside face of said cap is substantilly flat and trapizoidal, and the outer side of said cap has a greater height than the inner side thereof.

10. A kicking shoe as in claim 1 wherein said shoe includes a sole and said sole is devoid of cleats beneath said toe box.

11. A kicking shoe as in claim 1 wherein said shoe includes a sole and which has cleats located only on a portion of said sole located beneath the metatarsal arch of a wearer's foot.

12. A kicking shoe as in claim 1 wherein said shoe includes a vamp and a toe box and said vamp has a medial, longitudinally extending opening therein which extends rearwardly from said toe box, and a series of eyelets in said vamp on each side of the opening and which are located at spaced intervals from the front of the toe box rearwardly.

13. A kicking shoe as in claim 12 and further comprising a tongue which extends rearwardly from said toe box.

14. A kicking shoe as in claim 12 and further including a first lace strung in eyelets adjacent said toe box, and a second lace strung in eyelets rearwardly of said toe box.

15. A kicking shoe as in claim 1 wherein said shoe includes a sole and said sole has a rear portion that extends beneath the heel of a wearer, an intermediate portion that extends beneath the plantar arch of a wearer, and a forward portion that extends beneath the metatarsal arch and the toes of a wearer, and said forward portion of the sole is permanently maintained in an upwardly flexed orientation with respect to the plantar surface reference line of the shoe.

16. A kicking shoe as in claim 15 wherein said rear portion of the sole is permanently maintained in a substantially level orientation with respect to the plantar surface reference line of said shoe, and said intermediate portion is permanently maintained in a downwardly flexed orientation with respect to said reference line.

17. A kicking shoe as in claim 15 wherein said shoe includes a toe box and said forward portion of the sole extends through a longitudinal plane, and further comprising a substantially flat cap at the front end of said toe box that is forwardly tilted with respect to said plane.

18. A kicking shoe as in claim 17 wherein said cap forwardly tilted at an angle within the range of about 100° to 110° to said plane when measured from the inside of the shoe.

19. A kicking shoe as in claim 1 including a toe box and further comprising anchoring means for laces attached to said toe box.

20. A kicking shoe as in claim 19 including a vamp and further comprising an upper attached to said vamp, and attachment means for said laces on each side of said upper.

21. A kicking shoe comprising a sole, a vamp, a toe box, and wedging means within the toe box for maintaining the toes of a wearer of the shoe in an upwardly flexed position, said sole having a rear portion that extends beneath the heel of a wearer, an intermediate portion that extends beneath the plantar arch of a wearer, and a forward portion that extends beneath the metatarsal arch and the toes of a wearer, said forward portion of the sole being permanently maintained in an upwardly flexed orientation with respect to the plantar surface reference line of the shoe, and wherein said wedging means is a wedge having a front section for abuttal with the bottom of the wearer's toes and a second section for abuttal with the bottom of the metatarsal arch of a wearer's foot, said wedging means being rigid and incompressible during normal use of the shoe and integral with said sole.

22. A kicking shoe as in claim 21 wherein said forward portion of the sole is permanently maintained in an upwardly flexed orientation of at least about 15° with respect to said plantar surface reference line.

23. A kicking shoe as in claim 22 wherein said wedge has an upper surface for abuttal with the toes and the metatarsal arch of a wearer, and said upper surface is upwardly inclined from said reference line at an angle exceeding that at which said forward portion of the sole is permanently maintained with respect to the reference line.

24. A kicking shoe comprising a sole, a vamp, a toe box, and wedging means within the toe box for maintaining the toes of a wearer of the shoe in an upwardly flexed position, said wedging means having an upper surface for abuttal with the bottom of a wearer's toes, said upper surface being inclined upwardly toward the front of the shoe, said upper surface of the wedging means having a rearwardly located second section for abuttal with the bottom of the metatarsal arch of a wearer's foot, said wedging means including merging front and rear portions over which said upper surface extends, and wherein said upper surface has a third section on said rear portion for abuttal with the bottom of the plantar arch of the wearer's foot.

* * * * *